US007334519B2

(12) United States Patent
Cho

(10) Patent No.: US 7,334,519 B2
(45) Date of Patent: Feb. 26, 2008

(54) ROTARY PRESS HAVING MULTIPLE PRINTING UNITS

(76) Inventor: Chung Cho, 3094 Seongnam-Dong, Jungwon-Gu, Seongnam-Shi, Kyungki-Do (KR)

( * ) Notice: Subject to any disclaimer, the term of this patent is extended or adjusted under 35 U.S.C. 154(b) by 103 days.

(21) Appl. No.: 10/544,152

(22) PCT Filed: Jan. 19, 2004

(86) PCT No.: PCT/KR2004/000085

§ 371 (c)(1),
(2), (4) Date: Aug. 1, 2005

(87) PCT Pub. No.: WO2004/069540

PCT Pub. Date: Aug. 19, 2004

(65) Prior Publication Data

US 2006/0048658 A1 Mar. 9, 2006

(30) Foreign Application Priority Data

Feb. 6, 2003 (KR) ..... 10-2003-0007333

(51) Int. Cl.
*B41F 5/16* (2006.01)

(52) U.S. Cl. ..... 101/180; 101/181; 101/183; 101/219

(58) Field of Classification Search ..... None
See application file for complete search history.

(56) References Cited

U.S. PATENT DOCUMENTS

| | | | | |
|---|---|---|---|---|
| 2,368,341 A * | 1/1945 | Zuckerman | ..... | 101/180 |
| 5,031,530 A * | 7/1991 | Burger | ..... | 101/211 |
| 5,197,385 A * | 3/1993 | Burger | ..... | 101/177 |
| 5,213,042 A | 5/1993 | Larios | | |
| 5,791,249 A | 8/1998 | Quadracci | | |
| 5,894,797 A * | 4/1999 | Brennan et al. | ..... | 101/226 |

FOREIGN PATENT DOCUMENTS

JP 56137968 A * 10/1981

* cited by examiner

*Primary Examiner*—Jill E. Culler
(74) *Attorney, Agent, or Firm*—IPLA P.A.; James E. Bame

(57) ABSTRACT

A rotary press is provided. In the rotary press, tension of paper passing through printing units is always maintained to be constant, and position of a printing pin of each printing unit is consistently maintained to thus prevent a pin secession phenomenon of a printed image from occurring, in such a manner that an output image of the rotary press becomes clear. Also, it is easy to change the structure of a one-side color printing rotary press into that of a double-side color printing rotary press. As a result, the rotary press can be used widely on a general purpose.

3 Claims, 7 Drawing Sheets

ROTARY PRESS HAVING MULTIPLE PRINTING UNITS

TECHNICAL FIELD

The present invention relates to a rotary press, and more particularly, to a rotary press in which tension of paper passing through printing units is always maintained to be constant, and position of a printing pin of each printing unit is consistently maintained to thus prevent a pin secession phenomenon of a printed image from occurring, in such a manner that an output image of the rotary press becomes clear, and it is also easy to change the structure of a one-side color printing rotary press into that of a double-side color printing rotary press, so as to use the rotary press widely on a general purpose.

BACKGROUND ART

In general, a rotary press means an apparatus which prints at high speed on printing materials such as newspaper, magazine and pamphlet.

FIGS. 6 through 8 are a schematic view showing a conventional rotary press, respectively. FIG. 6 is a schematic view showing a conventional double-side color printing rotary press for printing on newspaper at high speed, FIG. 7 is a schematic view showing a conventional commercial double-side color printing rotary press for printing at high speed on printing materials such as magazine and pamphlet, and FIG. 8 is a schematic view showing a conventional rotary press for one-side color printing on newspaper.

Referring to FIGS. 6 and 7, a conventional double-side color printing rotary press includes first and fourth printing units 1-4 which print different colored characters or figures on double sides of printing paper, respectively.

In each of the printing units 1-4, a pair of plate cylinders 5 and 6 are installed to oppose each other and a pair of blanket cylinders 7 and 8 are installed to oppose each other, in order to print on respectively different sides. Here, printing paper 9 passes through between the blanket cylinders 7 and 8 which oppose and contact each other.

In the case of the conventional rotary press having the above-described configuration, respectively different characters or figures are printed on the double sides of the printing paper 9 by the blanket cylinders 7 and 8 when the printing paper 9 passes through between the blanket cylinders 7 and 8 of each of the printing units 1-4.

That is, when printing paper 9 passes through the first printing unit 1, first colored characters or figures are printed on the double sides of the printing paper 9 by the blanket cylinders 7 and 8 in the first printing unit 1. When the printing paper 9 having passed through the first printing unit 1 passes through the second printing unit 2, second colored characters or figures are printed in the second printing unit 2. Thereafter, when the printing paper 9 passes through the third and fourth printing units 3 and 4, third and fourth colored characters or figures are respectively printed on the double sides of the printing paper 9.

Also, as shown in FIG. 8, blanket cylinders 7 and 8 and plate cylinders 5 and 6 for first-color printing on both sides of printing paper are formed in a first printing unit 1 of a one-side color printing rotary press. Also, a pair of cylinders having a blanket cylinder 7 and a plate cylinder 5 for printing second-color, third-color and fourth-color characters or figures in sequence, on one side of printing paper in second through fourth printing units 2 through 4 of the one-side color printing rotary press.

However, since printing paper passes through between blanket cylinders in a linear contacting manner when passing through each printing unit in the conventional rotary press, color pins are seceded due to moving of the printing paper at the time of changing in speed or tension of the printing paper to be fed, to thereby lower positional correctness of characters or figures of different colors which are printed on printing paper, and thus prevent accurate printing due to mismatched focus of contents to be finally printed, or occurring of pin secession.

In particular, printing paper for newspaper is severely expanded one thousands at maximum due to ink and moisture which are supplied during printing in a newspaper rotary press and thus a printing effect becomes further lowered.

Since even a one-side color printing rotary press also includes four printing units as in a double-side color printing rotary press, the structure of the one-side color printing rotary press becomes complicated unnecessarily. Since it is difficult to change structure of a one-side color printing rotary press into that of a double-side color printing rotary press, an additional double-side color printing rotary press should be purchased even at a state provided with a one-side color printing rotary press, to accordingly increase an economic load on users.

DISCLOSURE OF THE INVENTION

To solve the above problems, it is an object of the present invention to provide a rotary press in which tension of paper passing through printing units is always maintained to be constant, and position of a printing pin of each printing unit is consistently maintained to thus prevent a pin secession phenomenon of a printed image from occurring, in such a manner that an output image of the rotary press becomes clear, and it is also easy to change the structure of a one-side color printing rotary press into that of a double-side color printing rotary press, so as to use the rotary press widely on a general purpose.

To accomplish the above object of the present invention, according to an aspect of the present invention, there is provided a rotary press comprising: a first printing unit including a pair of a first blanket cylinder and a first plate cylinder for printing a first color on one side of printing paper and two pairs of second and third blanket cylinders and second and third plate cylinders which oppose each other with respect to the first blanket cylinder for printing the first color and a second color on the other side of the printing paper, wherein the second and third blanket cylinders contact the first blanket cylinder with a predetermined angle formed between the second and third blanket cylinders with respect to the first blanket cylinder so that the printing paper passing through the first through third blanket cylinders contact the first through third blanket cylinders in a surface-to-surface contacting manner; a second printing unit including a pair of blanket cylinders and a pair of plate cylinders which are located in each side of the printing paper having passed the first printing unit, in order to print a second color on one side of the printing paper and print a third color on the other side thereof; and a third printing unit including a pair of a fourth blanket cylinder and a fourth plate cylinder for printing a fourth color on one side of the printing paper having passed through the second printing unit and two pairs of fifth and sixth blanket cylinders and fifth and sixth plate cylinders which oppose each other with respect to the fourth blanket cylinder for printing the third color and the fourth color on the other side of the printing paper, wherein the fifth and sixth blanket cylinders contact the fourth blanket cylinder with a predetermined angle formed between the fifth and sixth blanket cylinders with respect to the fourth blanket cylinder so that the printing paper passing through the fourth through sixth blanket cylinders contact the fourth through sixth blanket cylinders in a surface-to-surface contacting manner.

According to another aspect of the present invention, there is also provided a rotary press comprising: a first printing unit including a first blanket cylinder, a first direct-printing cylinder and second and third blanket cylinders which contact the outer circumference of the first blanket cylinder in sequence, and second and third plate cylinders which are formed on one side of the second and third blanket cylinders respectively, wherein printing paper advances between the first blanket cylinder and the first direct-printing cylinder and then passes through the first through third blanket cylinders to be discharged toward the next printing stage, so that first through third colors are printed on one side of the printing paper; and a second printing unit including a pair of blanket cylinders and a pair of plate cylinders which are located in each side of the printing paper having passed the first printing unit, in order to print a fourth color on one side of the printing paper and print the first color on the other side thereof.

Preferably, the rotary press further comprises a third printing unit including a fourth blanket cylinder, a second direct-printing cylinder and fifth and sixth blanket cylinders which contact the outer circumference of the fourth blanket cylinder in sequence, and fifth and sixth plate cylinders which are formed on one side of the fifth and sixth blanket cylinders, respectively, wherein the printing paper having passed the second printing unit passes through the fourth through sixth blanket cylinders to then pass through between the fourth blanket cylinder and the second direct-printing cylinder to be discharged out, so that the second through fourth colors are printed on the other side of the printing paper.

BRIEF DESCRIPTION OF THE DRAWINGS

The above and other objects and advantages of the present invention will become more apparent by describing the preferred embodiments thereof in more detail with reference to the accompanying drawings in which.

BEST MODE FOR CARRYING OUT THE INVENTION

Hereinbelow, a rotary press according to the present invention will be described with reference to the accompanying drawings FIGS. 1 through 5.

Figure 1:
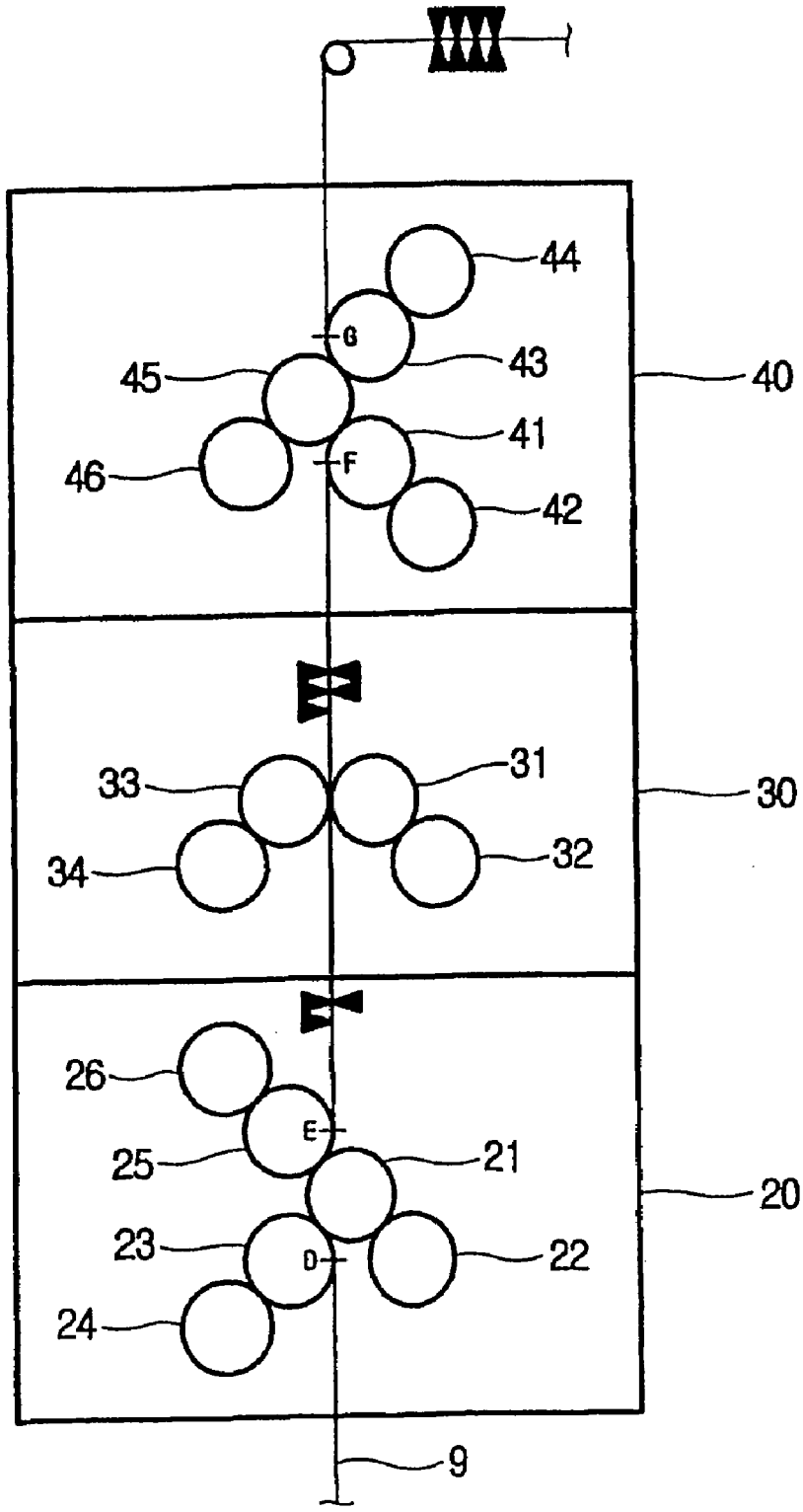
FIG. 1 is a schematic view showing a rotary press for four-color double-side printing according to the present invention.

FIG. 1 is a schematic view showing a rotary press for four-color double-side printing according to the present invention.

A rotary press according to the present invention includes first through third printing units 20-40.

A first printing unit 20 includes a pair of a first blanket cylinder 21 and a first plate cylinder 22 for printing a first color on one side of printing paper 9. The first printing unit 20 also includes two pairs of second and third blanket cylinders 23 and 25 and second and third plate cylinders 24 and 26 which oppose each other with respect to the first blanket cylinder 21 for printing the first color and a second color on the other side of the printing paper 9 in sequence.

Here, the second and third blanket cylinders 23 and 25 contact the first blanket cylinder 21 with a predetermined angle formed between the second and third blanket cylinders 23 and 25 with respect to the first blanket cylinder 21 so that the printing paper 9 passing through the first through third blanket cylinders 21, 23, and 25 contact the first through third blanket cylinders 21, 23, and 25 in a surface-to-surface contacting manner, between a point D of the second blanket cylinder 23 and a point E of the third blanket cylinder 25.

Meanwhile, the second printing unit 30 includes a pair of blanket cylinders 31 and 33 and a pair of plate cylinders 32 and 34 which are located in each side of the printing paper 9 having passed the first printing unit 20, in order to print a second color on one side of the printing paper 9 and print a third color on the other side thereof. Here, the blanket cylinders 31 and 33 oppose and contact each other, and the plate cylinders 32 and 34 oppose each other.

The third printing unit 40 includes a pair of a fourth blanket cylinder 45 and a fourth plate cylinder 46 for printing a fourth color on one side of the printing paper 9 having passed through the second printing unit 30. The third printing unit 40 also includes two pairs of fifth and sixth blanket cylinders 41 and 43 and fifth and sixth plate cylinders 42 and 44 which oppose each other with respect to the fourth blanket cylinder 45 for printing the third color and the fourth color on the other side of the printing paper 9, in sequence.

Here, the fifth and sixth blanket cylinders 41 and 43 contact the fourth blanket cylinder 45 with a predetermined angle formed between the fifth and sixth blanket cylinders 41 and 43 with respect to the fourth blanket cylinder 45 so that the printing paper 9 passing through the fourth through sixth blanket cylinders 41, 43, and 45) contact the fourth through sixth blanket cylinders (41, 43, 45) in a surface-to-surface contacting manner, between a point F of the fifth blanket cylinder 41 and a point G of the sixth blanket cylinder 43.

As described above, the rotary press according to the present invention makes it possible to perform a double-side printing operation only with three printing units 20-40, to thereby simplify the structure of the whole rotary press. Also, when printing paper 9 passes through the first printing unit 20 and the third printing unit 40, the printing paper 9 contacts the blanket cylinders in a surface-to-surface contacting manner. Accordingly, tension of the printing paper 9 in the first through third printing units 20-40 is always consistently maintained. As a result, positions of setting color pins of different colors which are printed in the respective printing units 20-40 are not changed, to thus decrease a pin secession phenomenon of printing matters, enhance accuracy of printed images, and reduce a loss of paper.

Figure 2:
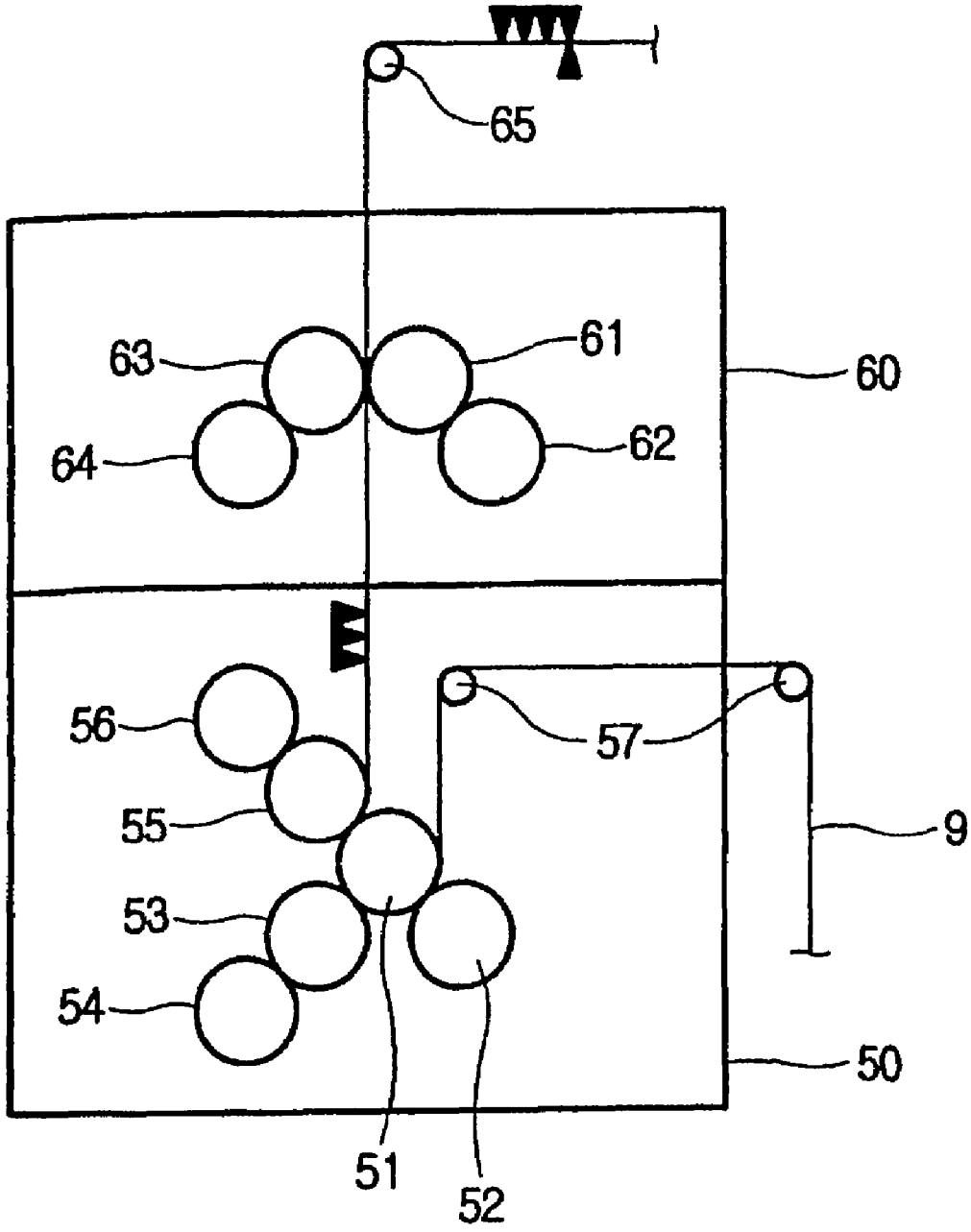
FIG. 2 is a schematic view showing a rotary press for four-color one-side printing according to the present invention.

Meanwhile, FIG. 2 is a schematic view showing a rotary press for one-side color printing according to the present invention. In the case of a one-side color printing, four colors are printed on one side of printing paper and one color is printed on the other side of the printing paper.

The one-side color printing rotary press according to the present invention generally includes a first printing unit 50 and a second printing unit 60.

In the one-side color printing rotary press, the first printing unit 50 prints first through third colors in sequence on one side of the printing paper 9. The first printing unit 50 includes a first blanket cylinder 51, a first direct-printing cylinder 52 and second and third blanket cylinders 53 and 55 which contact the outer circumference of the first blanket cylinder 51, and second and third plate cylinders 54 and 56 which are formed on one side of the second and third blanket cylinders 53 and 55, respectively. Here, printing paper 9 advances to the rear end of the first printing unit 50 via guide rollers 57, and then is fed between the first blanket cylinder 51 and the first direct-printing cylinder 52. Then, the printing paper 9 having passed between the first blanket cylinder 51 and the direct-printing cylinder 52 finally passes through the first through third blanket cylinders 51, 53, and 55.

As described above, when printing paper 9 passes through the first printing unit 50, a first color is printed on the printing paper 9 in the direct-printing cylinder 52, and then a second color and a third color are printed on the printing paper 9 in sequence by the blanket cylinders 53 and 55. Here, since the printing paper 9 passes through the central blanket cylinder 51 in a surface-to-surface contacting manner, while enclosing the central blanket cylinder 51, tension of the printing paper 9 is maintained as it is, to thereby provide an effect of enhancing clearness of a printed image.

Meanwhile, the second printing unit 60 includes a pair of blanket cylinders 61 and 63 and a pair of plate cylinders 62 and 64 in order to print a fourth color on one side of the printing paper 9 having passed through the first printing unit 50, and print the first color on the other side thereof. The printing paper 9 having passed through the second printing unit 60 is discharged via a guide roller 65.

As described above, it can be seen that the structure of the one-side color printing rotary press has been simplified from the conventional four printing units into the two printing units according to the present invention.

Figure 3:
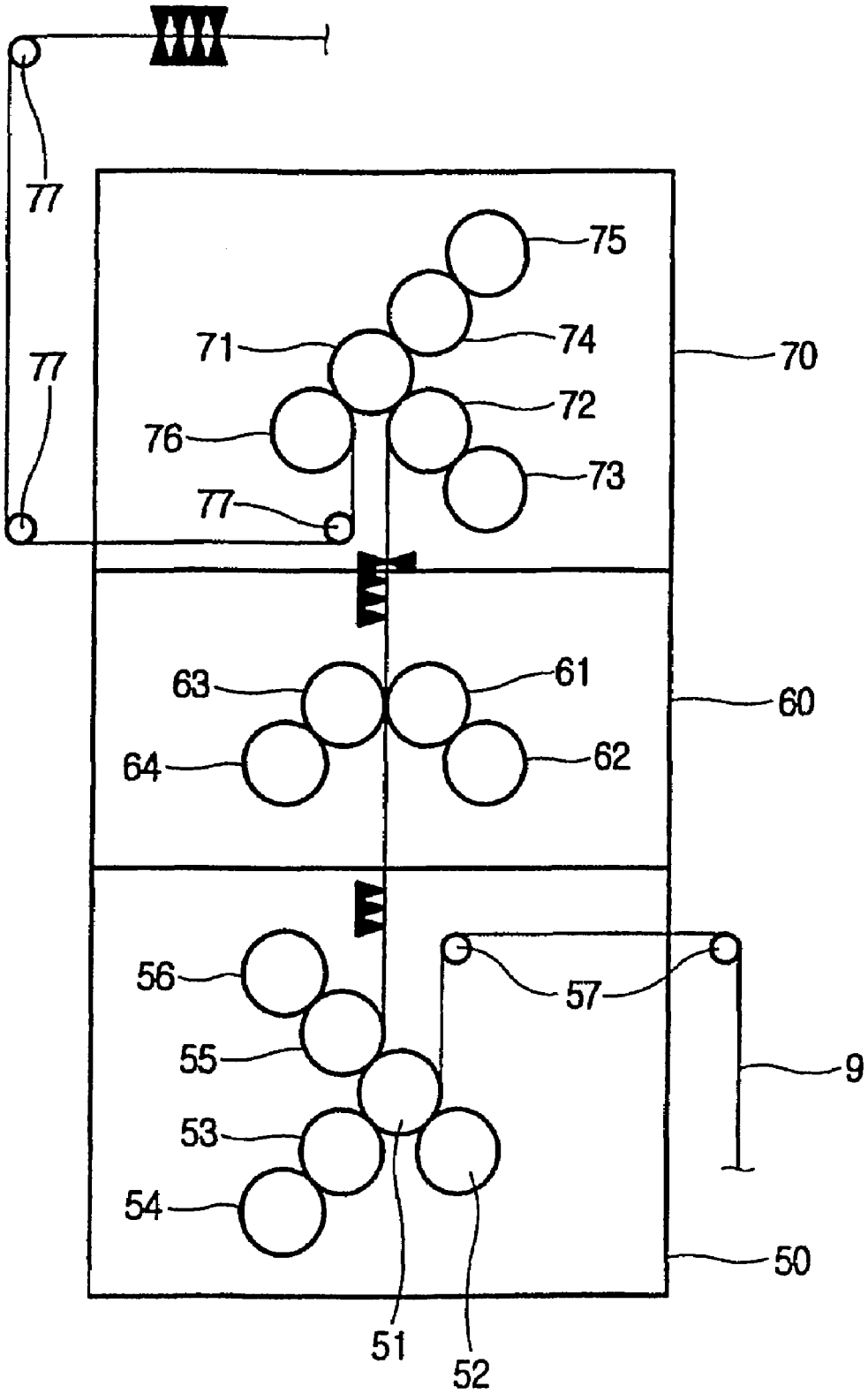
FIG. 3 is a schematic view showing a rotary press for four-color double-side printing according to another embodiment of the present invention.

FIG. 3 is a schematic view showing a rotary press for four-color double-side printing according to another embodiment of the present invention, differently from the FIG. 1 printing method.

That is, the above-described one-side color printing rotary press further includes a third printing unit 70, in order to form a double-side color printing rotary press.

The third printing unit 70 includes a fourth blanket cylinder 71 around which the printing paper 9 having passed through the second printing unit 60 is wound to then be discharged via guide rollers 77. Also, the third printing unit 70 includes fifth and sixth blanket cylinders 72 and 74 which contact the outer circumference of the fourth blanket cylinder 71 and fifth and sixth plate cylinders 73 and 75 which are formed on one side of the fifth and sixth blanket cylinders 72 and 74, respectively, in order to print a second color and a third color on one side of the printing paper 9. A second direct-printing cylinder 76 contacts the rear end of the fourth blanket cylinder 71 in order to print a fourth color on the other side of the printing paper 9. Here, the printing paper 9 having passed the second printing unit 60 passes through the fourth through sixth blanket cylinders 71, 72, and 74 to then pass through between the fourth blanket cylinder 71 and the second direct-printing cylinder 76 to be discharged out, so that the second through fourth colors are printed on the other side of the printing paper 9.

As described above, the present invention adds the third printing unit 70 to the following end of the second printing unit 60, and thus can simply change the structure of a one-side color printing rotary press into that of a double-side color printing rotary press. Reversely, when a double-side color printing rotary press is changed into a one-side color printing rotary press, only the third printing unit 70 can be separated from the whole rotary press to thus simply realize a one-side color printing rotary press from a double-side color printing rotary press.

Figure 4:
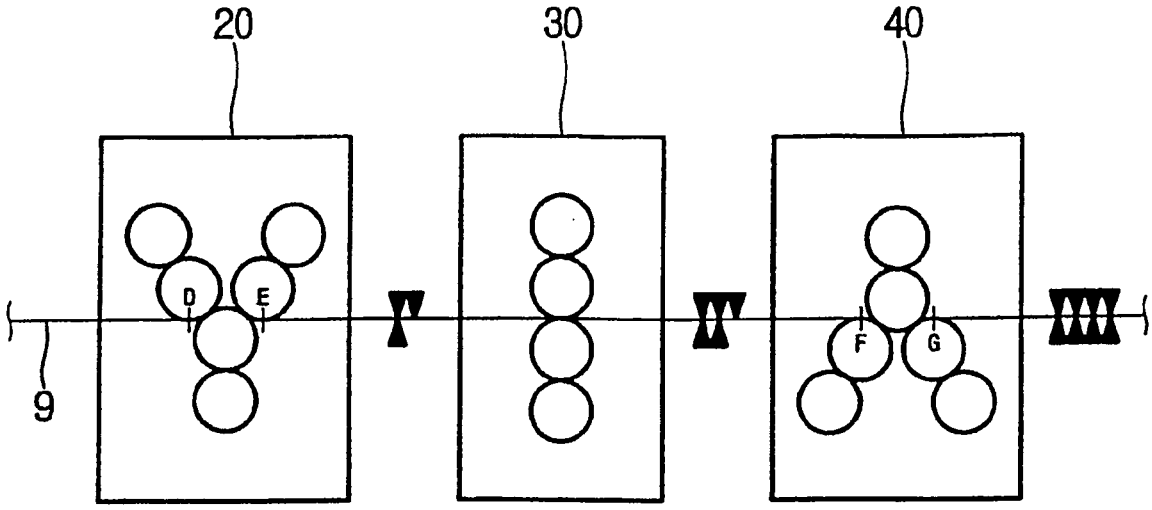
FIG. 4 is a schematic view showing a state where a rotary press for four-color double-side printing according to the present invention is applied to a commercial rotary press.
Figure 5:
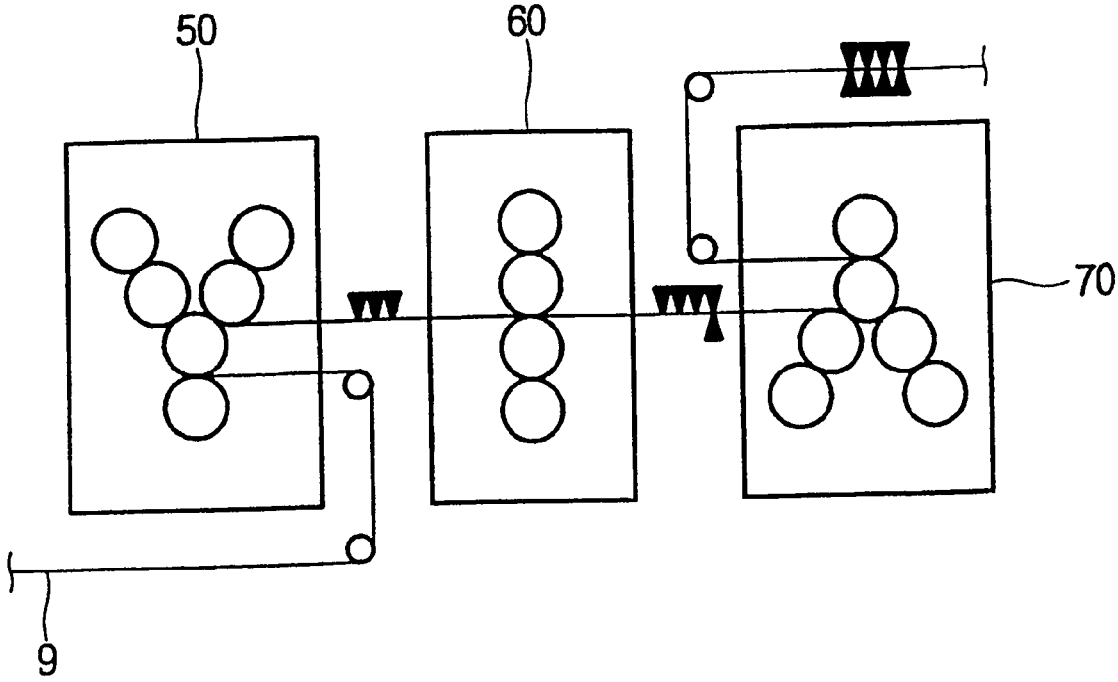
FIG. 5 is a schematic view showing a state where a rotary press for four-color double-side printing according to another embodiment of the present invention is applied to a commercial rotary press.
Figure 6:
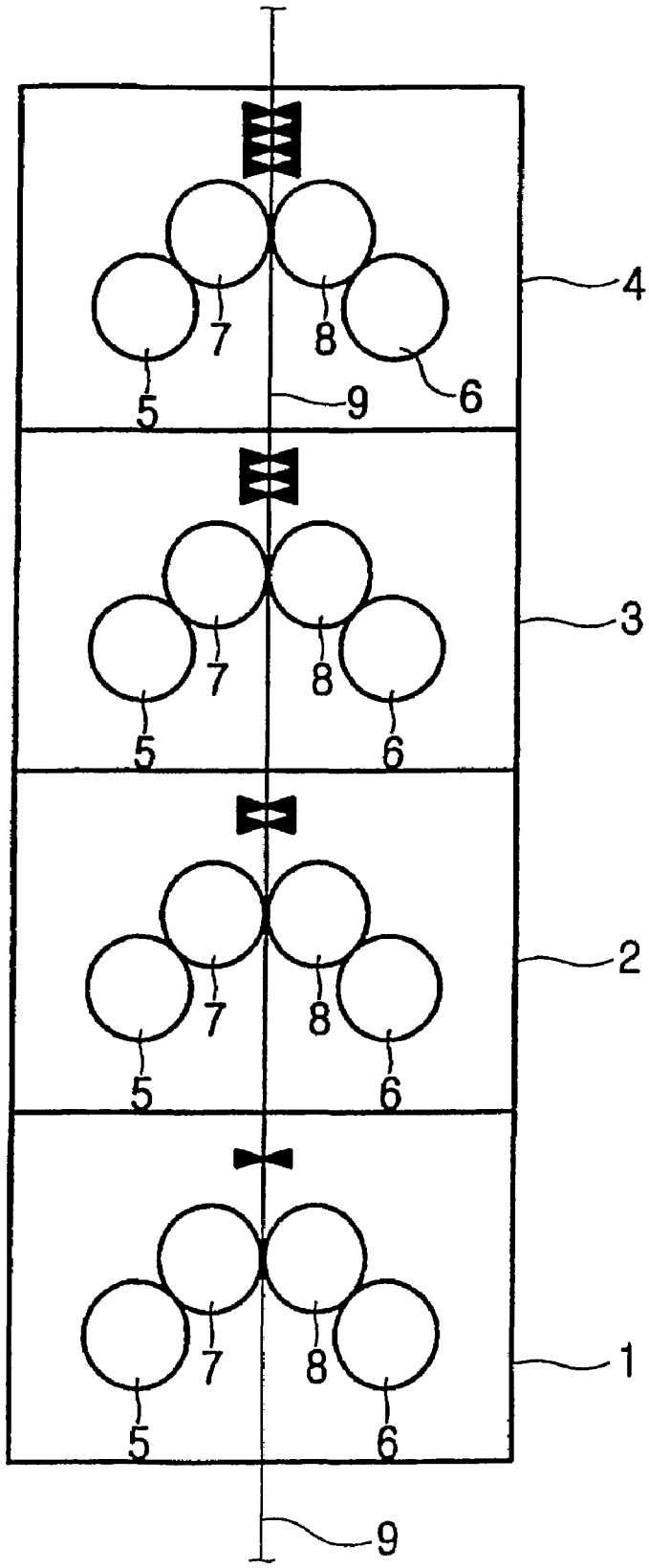
FIG. 6 is a schematic view showing a conventional rotary press for printing on newspaper.
Figure 7:
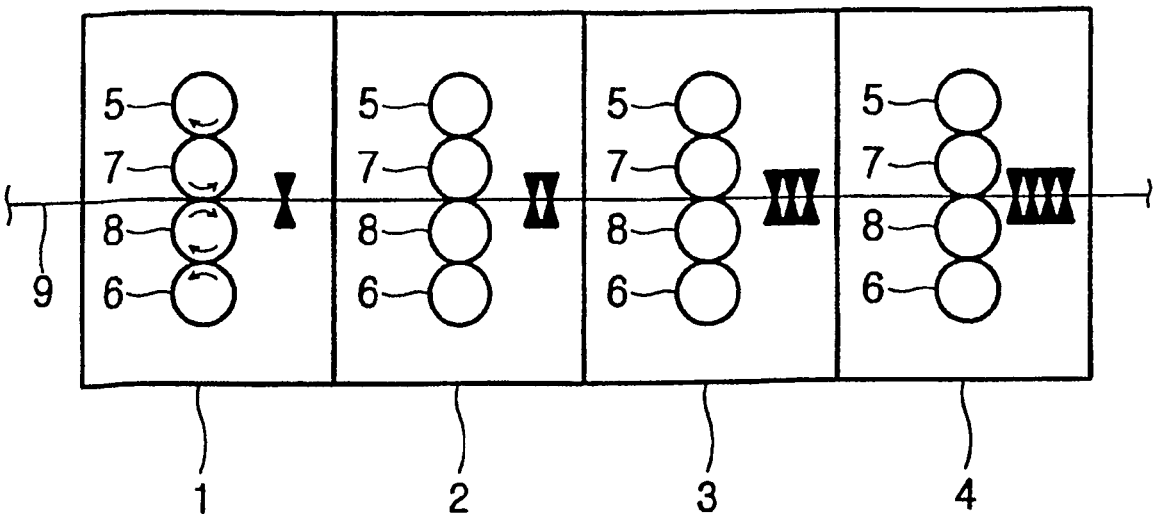
FIG. 7 is a schematic view showing a conventional commercial rotary press.
Figure 8:
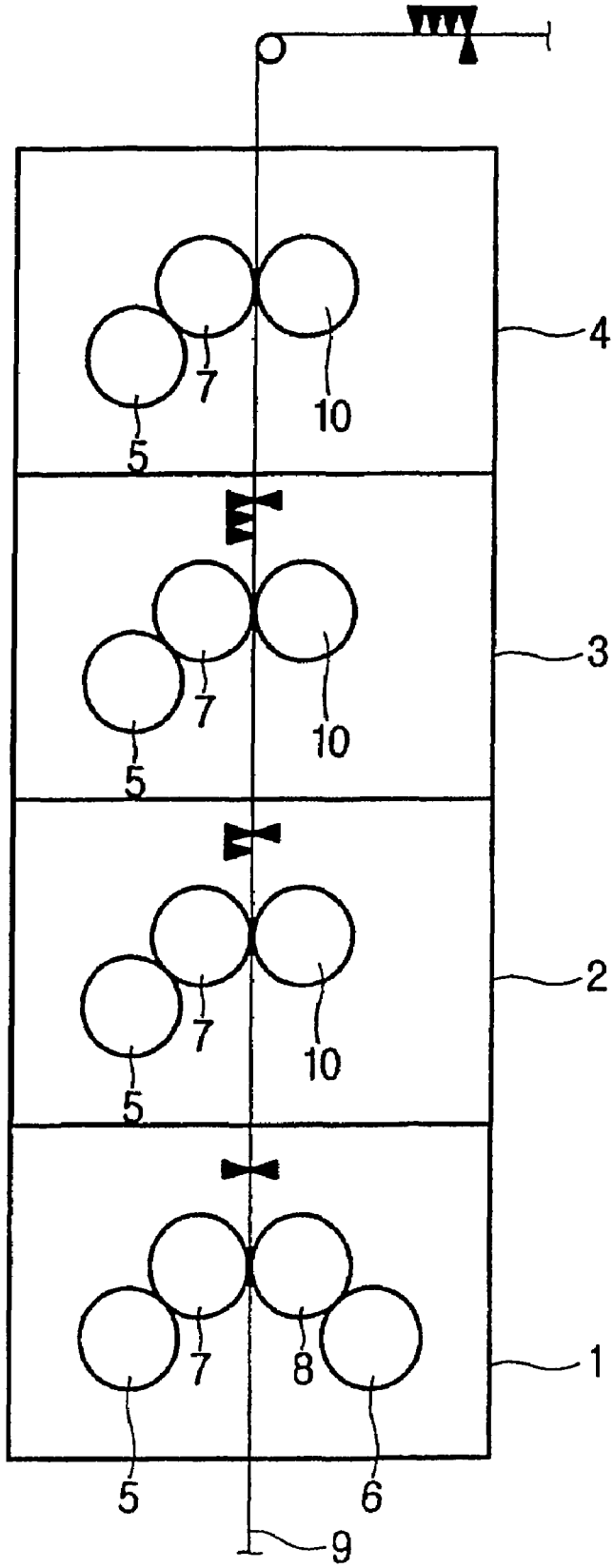
FIG. 8 is a schematic view showing a conventional commercial rotary press for one-side printing.

Meanwhile, FIG. 4 is a schematic view showing a state where a rotary press for four-color double-side printing according to the present invention is applied to a commercial rotary press, and FIG. 5 is a schematic view showing a state where a rotary press for four-color double-side printing according to another embodiment of the present invention is applied to a commercial rotary press. As shown in FIGS. 4 and 5, the rotary press according to the present invention can be widely applied to a newspaper printing rotary press or a commercial rotary press for printing magazines or pamphlets on a general purpose manner.

INDUSTRIAL APPLICABILITY

As described above, the present invention provides a rotary press, in which tension of paper passing through printing units is always maintained to be constant, and position of a printing pin of each printing unit is consistently maintained to thus prevent a pin secession phenomenon of a printed image from occurring, in such a manner that an output image of the rotary press becomes clear. Also, it is easy to change the structure of a one-side color printing rotary press into that of a double-side color printing rotary press. As a result, the rotary press can be used widely on a general purpose.

As described above, the present invention has been described with respect to a particularly preferred embodiment. However, the present invention is not limited to the above embodiment, and it is possible for one who has an ordinary skill in the art to make various modifications and variations, without departing off the spirit of the present invention.

What is claimed is:

1. A rotary press comprising:

a first printing unit including a pair of a first blanket cylinder and a first plate cylinder for printing a first color on one side of a printing paper and two pairs of second and third blanket cylinders and second and third plate cylinders which oppose each other with respect to the first blanket cylinder for printing the first color and a second color on the other side of the printing paper, wherein the second and third blanket cylinders contact the first blanket cylinder with a predetermined angle formed between the second and third blanket cylinders with respect to the first blanket cylinder so that the printing paper passing through the first through third blanket cylinders contacts the first through third blanket cylinders in a surface-to-surface contacting manner between a point on a circumference of the second blanket cylinder and a point on a circumference of the third blanket cylinder;

a second printing unit including a pair of blanket cylinders and a pair of plate cylinders which are located in each side of the printing paper having passed the first printing unit, in order to print a second color on one side of the printing paper and print a third color on the other side thereof; and a third printing unit including a pair of a fourth blanket cylinder and a fourth plate cylinder for printing a fourth color on one side of the printing paper having passed through the second printing unit and two pairs of fifth and sixth blanket cylinders and fifth and sixth plate cylinders which oppose each other with respect to the fourth blanket cylinder for printing the third color and the fourth color on the other side of the printing paper, wherein the fifth and sixth blanket cylinders contact the fourth blanket cylinder with a predetermined angle formed between the fifth and sixth blanket cylinders with respect to the fourth blanket cylinder so that the printing paper passing through the fourth through sixth blanket cylinders contacts the fourth through sixth blanket cylinders in a surface-to-surface contacting manner between a point on a circumference of the fifth blanket cylinder and a point on a circumference of the sixth blanket cylinder, wherein a tension of the printing paper passing through the printing units is maintained to be constant, and wherein a position of a printing pin of each printing unit is consistently maintained so as to prevent a pin secession phenomenon of a printed image from occurring.

2. A rotary press comprising:

a first printing unit including a first blanket cylinder, a first direct-printing cylinder and second and third blanket cylinders which contact the outer circumference of the first blanket cylinder in sequence, and second and third plate cylinders which are formed on one side of the second and third blanket cylinders, respectively, wherein a printing paper advances between the first blanket cylinder and the first direct-printing cylinder and then passes through the first through third blanket cylinders to be discharged toward the next printing stage in a surface-to-surface contacting manner between a point on a circumference of the first blanket cylinder and a point on a circumference of third blanket cylinder, so that first through third colors are printed on one side of the printing paper; and a second printing unit including a pair of blanket cylinders and a pair of plate cylinders which are located in each side of the printing paper having passed the first printing unit, in order to print a fourth color on one side of the printing paper and print the first color on the other side thereof, wherein a tension of the printing paper passing through the printing units is maintained to be constant, and wherein a position of a printing pin of each printing unit is consistently maintained so as to prevent a pin secession phenomenon of a printed image from occurring.

3. The rotary press according to claim 2, further comprising:

a third printing unit including a fourth blanket cylinder, a second direct-printing cylinder and fifth and sixth blanket cylinders which contact the outer circumference of the fourth blanket cylinder in sequence, and fifth and sixth plate cylinders which are formed on one side of the fifth and sixth blanket cylinders, respectively, wherein the printing paper having passed the second printing unit passes through the fourth through sixth blanket cylinders to then pass through between the fourth blanket cylinder and the second direct-printing cylinder to be discharged out in a surface-to-surface contacting manner between a point on a circumference of the fifth blanket cylinder and a point on a circumference of the second direct-printing cylinder, so that the second through fourth colors are printed on the other side of the printing paper.

* * * * *